5/28/85 OR 4,520,364 SR

United States Patent [19]

Perry

[11] Patent Number: 4,520,364

[45] Date of Patent: May 28, 1985

[54] ATTACHMENT METHOD-CERAMIC RADOME TO METAL BODY

[75] Inventor: John S. Perry, Seattle, Wash.

[73] Assignee: The United States of America as represented by the Secretary of the Air Force, Washington, D.C.

[21] Appl. No.: 486,603

[22] Filed: Apr. 19, 1983

[51] Int. Cl.[3] ..... H01Q 1/28; H01Q 1/42

[52] U.S. Cl. ..... 343/872

[58] Field of Search ..... 343/872, 705, 708

[56] References Cited

U.S. PATENT DOCUMENTS 3,114,319 12/1963 Smith ..... 102/92.5

3,545,146 12/1970 Kerr ..... 52/80

3,757,698 9/1973 Jacobson ..... 102/70.2 R

*Primary Examiner*—Eli Lieberman

*Attorney, Agent, or Firm*—Donald J. Singer; Charles E. Bricker

[57] ABSTRACT

A radome assembly for an airframe and a method for attaching the assembly to an airframe are provided. The radome assembly comprises a ceramic shell with a polymeric transition section bonded thereto, which shell is adapted for mounting to a metal airframe. The transition section has a coefficient of thermal expansion intermediate between that of the ceramic shell and that of the metal airframe.

The method of this invention comprises preloading the transition section in circumferential compression when the radome assembly is attached to the airframe.

6 Claims, 2 Drawing Figures

ATTACHMENT METHOD-CERAMIC RADOME TO METAL BODY

RIGHTS OF THE GOVERNMENT

The invention described herein may be manufactured and used by or for the Government of the United States for all governmental purposes without the payment of any royalty.

BACKGROUND OF THE INVENTION

This invention relates to means for attaching a ceramic dome to an airframe.

Ceramic radomes appear to offer the best combination of low weight, high temperature strength, electromagnetic transmissibility, and thermal insulation, particularly for missiles encountering boundary layer temperatures over 800° F. (425° C.). The problem of attaching ceramic domes to metallic airframes arises from two fundamental differences in the characteristics of ceramics and metals. The first and probably most important characteristic is that of the coefficients of thermal expansion. Metals generally have higher coefficients of thermal expansion than ceramics. The second characteristic is that of thermal conductivity. Metals have relatively high thermal conductivity, while that of ceramics is relatively low.

Under conditions of rapid temperature increase at the external surfaces of a radome or nose cone, as occurs in flight due to aerodynamic heating effects, it is found that the radome mounting bracket of the metal airframe may become hotter than the ceramic radome because of the differing thermal conductivity characteristics. As a result of the higher thermal conductivity and expansion, the metal body expands radially to a greater degree and faster than the ceramic body. Direct attachment of the ceramic body to the metal body affords no allowance for differential expansion, and this produces a severe tensile stress in the ceramic wall resulting in fracture or complete failure of the ceramic body inasmuch as ceramics typically have relatively low tensile strengths. Slotting of the metal body to avoid circumferential stress permits leakage of high temperature air into the interior of the airframe, which could damage interior components.

There have been several approaches to attaching ceramic radomes to metal airframes; however, most approaches are either complex, difficult to assemble, or ineffective.

It is an object of the present invention to provide a radome assembly which overcomes the aforementioned disadvantages.

It is another object of the present invention to provide a method for attaching a ceramic radome to a metal airframe which overcomes the aforementioned disadvantages.

Other objects, aspects and advantages of the present invention will become apparent from the following detailed description of the invention, together with the appended claims and the accompanying drawing.

SUMMARY OF THE INVENTION

In accordance with the present invention, there is provided a radome assembly adapted for mounting on a metal body which comprises a ceramic shell and a polymeric transition section, wherein the transition section is bonded firmly to the ceramic shell and is adapted for mounting to the metal body.

Also provided in accordance with the present invention is a method for attaching a ceramic radome to a metal airframe which comprises providing a polymeric transition member having a coefficient of thermal expansion intermediate between that of the ceramic radome and that of the metal airframe, and preloading the transition member in circumferential compression when the radome assembly is attached to the airframe.

DETAILED DESCRIPTION OF THE DRAWING

Figure 1:
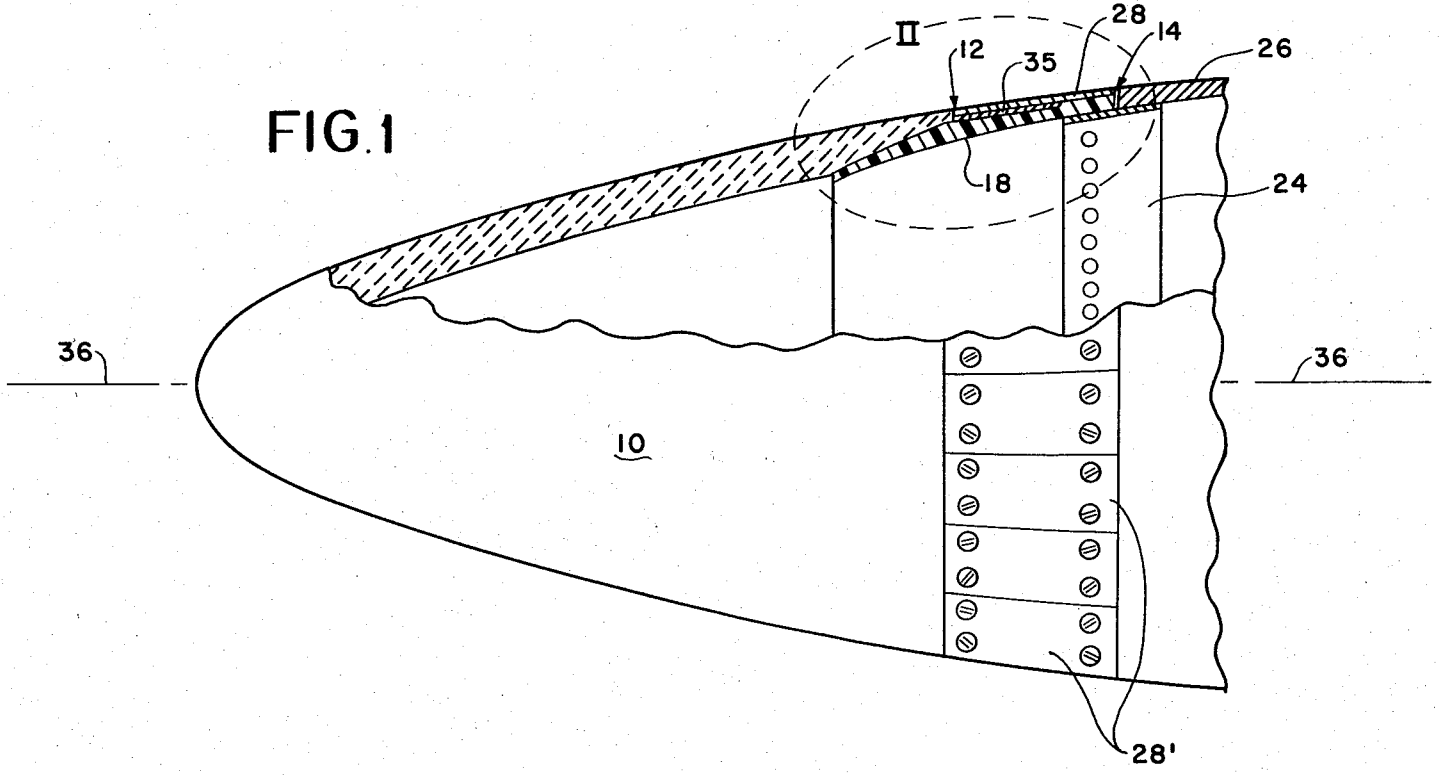
Figure 2:
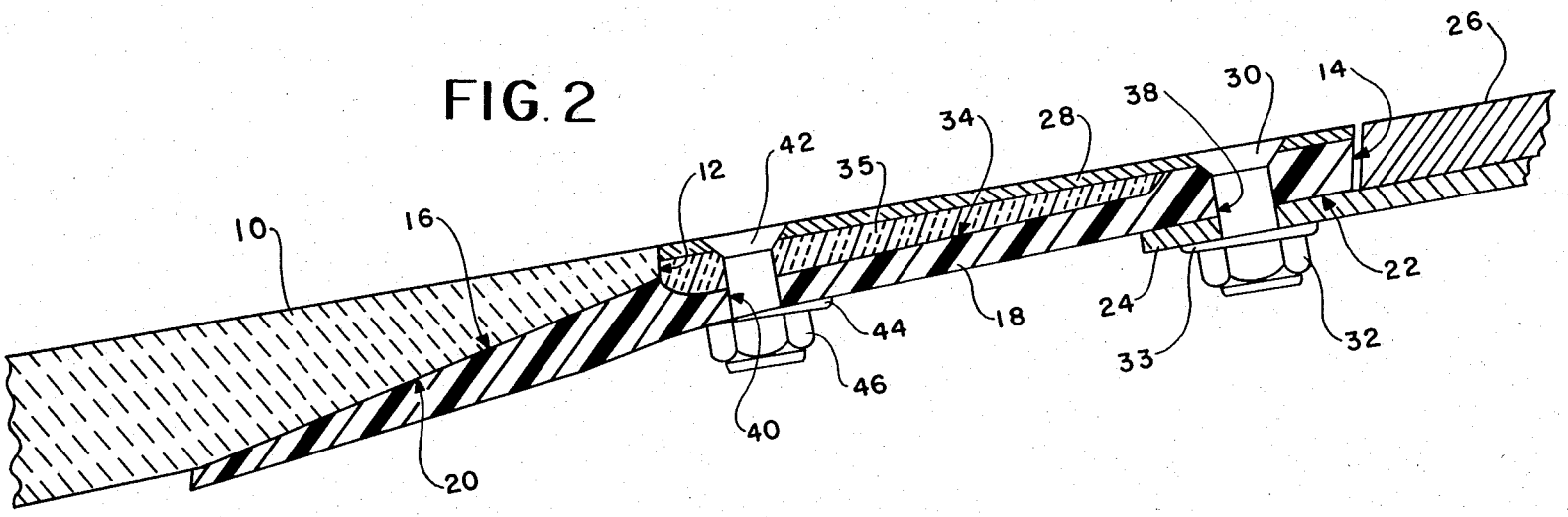

In the drawing,

FIG. 1 is a side elevation view, partly in longitudinal section, of a nose radome, showing its attachment to a forward section of a metal airframe; and FIG. 2 is an enlarged detail view of a portion of the radome indicated by the Roman numeral II in FIG. 1 showing the construction of the radome and its connection to the metal airframe.

DESCRIPTION OF THE PREFERRED EMBODIMENT

Referring now to the drawings wherein like reference numerals designate identical or corresponding parts throughout the several views, a generally conical formed ceramic shell 10 is provided at the forward end of a radome. The shell 10 may be of any type ceramic, such as alumina, silica, silicon nitride, and the like, having desirable physical and electrical characteristics.

The shell 10 ends at a base edge 12 located a suitable distance forward of the radome assembly rear edge 14. The inner face of shell 10 is tapered near the base edge 12, as shown at 16, for bonding the shell to a transition section 18 having a first end portion with a complementary outer taper, as shown at 20.

The aft portion of the transition section 18 is provided with an inner surface 22 for securing to a flange 24 of an airframe nose 26. In many, if not most, situations the nose 26 will be substantially cylindrical; consequently, the flange 24 and the inner surface 22 will also be substantially cylindrical. The thickness of the aft portion of the transition section is approximately equal to the depth of the flange 24 less the thickness of a fairing 28, as will be explained later. The relatively thick aft portion extends forward from the rear edge 14 a distance approximately equal to the longitudinal width of the flange 24, so as to provide a base for securing the radome assembly to the flange 24 with screws 30, nuts 32, and washers 31.

The middle portion of the transition section 18, i.e., the portion between the base edge 12 of the shell 10 and the relatively thick aft portion, has a circumferential recess, as indicated at 34. This recess is filled with an insulating material 35, such as Fiberfax, an aluminum silicate fibrous material available from the Carborundum Co.

The transition section 18 is a composite material fabricated from a plurality of plies of woven graphite broadgoods impregnated with a suitable high-temperature resin, such as a polyimide resin. The graphite broadgoods may be a plain weave fabric with equal denier fibers in the warp and fill directions. A suitable fiber is "Celion 6000", available from the Celanese Corporation. It is also within the scope of this invention to employ a fabric having a weave other than "plain".

The transition section 18 may be fabricated by first cutting a plurality of individual patterns from the resin-impregnated graphite broadgoods, using one or more suitably shaped templates. Certain of the patterns are cut so that the warp and fill threads will be oriented at 0° and 90° relative to the longitudinal axis of the radome assembly, as indicated at 36. Other of the patterns are cut so that the warp and fill threads will be oriented ±45° relative to the longitudinal axis 36.

The various patterns are assembled on a suitably shaped mandrel with the 0°/90° patterns alternating with the ±45° patterns so that the transition section will be isotropic. Sufficient alternating plies of fabric are employed to provide sufficient thickness to allow machining to final dimensions. The layup is balanced throughout to prevent warpage or thermal stresses following curing and machining. The resulting preform assembly is then cured in accordance with procedures known in the art to unite the various plies, and thereafter the cured assembly is machined to the cross section shown.

The resin with which the graphite fabric is impregnated should have a high glass transition temperature, and high strength and good resistance to aging at elevated temperatures. Suitable resins include heterocyclic resins, such as the polyimides, polybenzimidazoles and polybenzothiazoles. The polyimide resins are presently preferred. Both condensation type and addition type polyimides are available commercially. The condensation resins are limited in their usefulness because the laminates or composite materials produced from them exhibit void contents as high as 20 to 40%. The addition type polyimides generally provide laminates and/or composites which are quite low in voids.

The preform is cured by heating to a temperature in the approximate range of 200° to 325° C. for about 1 to 6 hours under a positive pressure of up to about 250 psi. The resulting freestanding preform may be removed from the mandrel after cooling, then subjected to a postcuring cycle comprising heating the freestanding preform to about 300° to 350° C. for about 4 to 24 hours or more. The preform is then machined as discussed previously.

Following machining, the transition section 18 is adhesively joined to the shell 10 using a suitable high temperature adhesive at the interface between the shell taper 16 and the transition section taper 20. The adhesive may comprise one of the aforementioned high temperature resins, preferably a polyimide resin, and one or more thickeners such as silica, aluminum powder, alumina or the like. The adhesive may be cured and postcured as discussed previously.

In the machining step the inner surface 22 of the aft portion of the transition section 18 is machined to an inside diameter (I.D.) greater than the outside diameter (O.D.) of the flange 24 by a factor F of about $1+(\alpha_1-\alpha_2)t$, where $\alpha_1$ and $\alpha_2$ are the coefficients of thermal expansion of the metal flange and the transition ring, respectively, and t is the expected increase in temperature. In the case of a metal airframe nose 26 and metal flange 24 having a coefficient $\alpha_1=4.5\times10^{-6}$ and a polyimide/graphite transition section 18 having a coefficient $\alpha_2=2.7\times10^{-6}$, and an expected temperature rise of about 400° C. ($\overline{RT}$ to 800° F.), this factor is about 1.0007192. Thus, for example, for a flange 24 O.D. of 12 inches, the surface 22 of the transition section 18 should be machined to an I.D. of 12.00863 inches.

In preparation for joining the radome assembly to the airframe nose 26, shims are placed between the two parts. The thickness of these shims is one-half the total expected differential radial expansion. Using the values of the example given in the preceding paragraph, the expected differential radial expansion is 12.00863-12 or 0.00863 inch. The thickness of the shims is ½(0.00863) or 0.004315 inch. Alignment marks are made on the transition section and on the airframe nose. Holes 38 for the screws 30 are then drilled through the transition section 18 and the flange 24 at desired circumferential intervals. The shims are then removed. A series of holes 40 are also drilled circumferentially in the middle portion of the transition section 18.

Prior to or during final assembly, the recess 34 is filled with insulating material 35. The insulating material 35 may be maintained in place in the recess 34 using a suitable adhesive or other suitable means, such as adhesive tape, not shown.

The fairing 28 is made of a plurality of sections 28', as shown in FIG. 1. One edge of each of the sections 28' is flanged so that each section 28' overlaps its neighbor and the whole fairing 28 presents a relatively smooth outer surface. This overlapping allows for expansion and contraction of the fairing 28 without having gaps between sections 28' which could allow hot gases to infringe upon the transition section 18 and/or the insulation material 35.

For final assembly of the radome to the airframe nose 26 the drilled radome is positioned on the nose 26 using the previously made alignment marks. The fairing sections 28' are positioned and screws 30 are inserted through the holes 38. Washers 31 and nuts 32 are placed onto screws 30. Screws 42 are inserted through holes 40, then washers 44 and nuts 46 are placed thereon. The screws 30 are tightened in such manner as to evenly and tightly compress the transition section 18 around the flange 24. The screws 42 are tightened so as to fair in the forward ends of the sections 28' to the proper aerodynamic contour.

Thus, the present invention provides a method for attaching a radome comprising a conical ceramic shell having a low coefficient of thermal expansion to a metal airframe having a much greater coefficient of thermal expansion. The transition section 18 has a coefficient of thermal expansion between that of the ceramic shell and that of the metal airframe. The transition section 18 is machined to an inside diameter greater than the outside diameter of the mounting flange of the airframe nose. When the radome assembly is attached to the airframe nose, the transition section is preloaded in circumferential compression. The modulus of the transition section is sufficient to allow such preloading without cracking or transmitting significant stresses to the transition section/ceramic interface 16/20. Further, the construction of the transition section 18 is such that radial flexure can take place without causing damaging stress in the ceramic shell 10 or the transition section 18. Also, this construction permits the moment and shear loads from airload and inertia on the ceramic shell 10 to be carried across the transition section 18, in the deflected high temperature condition, without failure due to buckling and/or shear.

In general, the height of the transition section 18 taken in the longitudinal direction 36 will be about 25 to 45 percent of the height of the conical ceramic shell 10, also taken in the longitudinal direction. About 30–40 percent of the total height of section 18 comprises the bonding taper 20; another 30–40 percent comprises the recess 34 and the remainder comprises the aft portion thereof. The transition section 18 has a minimum thickness through the portion at the recess 34 of about 1 mm, preferably about 2 mm. The combination of modulus, thickness and length of the center portion, i.e., the recessed portion, of the transition section 18 allows relative motion due to thermal expansion to be accommodated with only moderate stresses in all the various components. This construction does not require axial slotting to relieve circumferential stress, so a perfect seal is maintained against hot external air flowing into the internal cavity of the radome or the airframe.

Another feature of the construction of the present invention is the outer fairing 28. It is made in sections, which prevents buildup of circumferential stress, and is adjusted by the tension hold down screws 42 near the forward end to fair in fairing 28 to the proper aerodynamic contour between the ceramic shell 10 and the airframe nose 26. The insulating material 35 between the fairing 28 and the relatively thin portion of the transition section 18 minimizes temperature buildup in section 18 and prevents aerodynamic flutter of fairing 28.

Reasonable variations in the invention are possible without departing from the spirit of some or the scope of the appended claims.

I claim:

1. A radome assembly comprising a conical ceramic shell, a polymeric transition section, a layer of insulating material and a metal fairing adapted for mounting on a substantially cylindrical supporting structure, said supporting structure having an outer diameter and a support flange for receiving said assembly, said flange having a lesser outer diameter;

wherein said conical ceramic shell has a base edge and an inner face adapted for joining to said transition section;

wherein said transition section has a first end portion, an aft portion and a middle portion therebetween, said first end portion having an outer surface complementary to said inner face of said shell, said middle portion having a circumferential recess in the outer surface thereof for receiving therein a layer of said insulating material, and said aft portion having an inside diameter adapted for mounting over said support flange; and wherein said metal fairing circumferentially surrounds said transition section including said layer of insulating material, between said supporting structure and said base edge of said ceramic shell.

2. The assembly of claim 1 wherein said inside diameter of said aft portion of said transition section is greater than said lesser outer diameter of said flange by a factor of about $1+(\alpha_1-\alpha_2)t$, wherein $\alpha_1$ is the coefficient of thermal expansion of said metal flange, $\alpha_2$ is the coefficient of thermal expansion of said transition section, and t is the expected rise in temperature.

3. The assembly of claim 1 wherein said inner face of said shell is tapered, wherein said first end portion of said transition section has a taper complementary thereto, and wherein said tapers are adhesively bonded one to the other.

4. The assembly of claim 1 wherein said transition section is a cured composite of a plurality of plies of woven graphite broadgoods impregnated with a high-temperature resin, wherein plies of said broadgoods having the warp and fill threads thereof oriented at 0° and 90° alternate with plies of said broadgoods having the warp and fill threads oriented at ±45°.

5. The assembly of claim 1 wherein said metal fairing consists of a plurality of sections, each section having one edge thereof flanged.

6. A method for attaching a radome assembly including a ceramic shell to the mounting flange of a metal airframe, said mounting flange having an outer diameter, which comprises the steps of:

(a) providing a polymeric transition section having a coefficient of thermal expansion intermediate between the coefficient of said ceramic shell and the coefficient of said metal airframe, and having a first end portion, an aft portion and a middle portion therebetween, said aft portion having an inside diameter adapted for mounting over said mounting flange, wherein said inside diameter of said aft portion is greater than the outside diameter of said mounting flange by a factor F of about $$1+(\alpha_1-\alpha_2)t$$

wherein $\alpha_1$ is the coefficient of thermal expansion of said mounting flange, $\alpha_2$ is the coefficient of thermal expansion of said transition section and t is the expected increase in temperature due to aerodynamic heating effects;

(b) joining said transition section to said ceramic shell; and (c) attaching the resulting radome assembly including said transition section to said airframe, wherein said transition section is preloaded in circumferential compression when said assembly is attached to said airframe.

* * * * *